United States Patent [19]

Mohr

[11] Patent Number: 4,836,074

[45] Date of Patent: Jun. 6, 1989

[54] MACHINE FOR CUTTING STACKS OF PAPER SHEETS AND THE LIKE

[76] Inventor: Wolfgang Mohr, Hundshager Weg 42, D-6238 Hofheim, Fed. Rep. of Germany

[21] Appl. No.: 66,089

[22] Filed: Jun. 24, 1987

[30] Foreign Application Priority Data

Jul. 9, 1986 [DE] Fed. Rep. of Germany ..... 3623004

[51] Int. Cl.[4] ..... B26D 7/02

[52] U.S. Cl. ..... 83/379; 83/14; 83/282; 414/907; 100/90

[58] Field of Search ..... 414/907; 83/379, 14, 83/282; 100/90

[56] References Cited

U.S. PATENT DOCUMENTS 4,509,417 4/1985 Brandt ..... 414/907 X

FOREIGN PATENT DOCUMENTS 2723162 11/1978 Fed. Rep. of Germany ..... 414/907

3101911 2/1982 Fed. Rep. of Germany ..... 83/167

*Primary Examiner*—Donald R. Schran

*Attorney, Agent, or Firm*—Peter K. Kontler

[57] ABSTRACT

A guillotine type cutting machine for stacks of paper sheets has a table which supports the stock to be cut and a knife which can sever the stock in a vertical cutting plane. A feeding unit is provided to advance the stock along the table across the cutting plane, and a hold-down device is provided at the cutting plane to engage and press upon the stock opposite the descending knife while the stock is being severed. This hold-down device further serves to bear upon the stock during expulsion of air from the stock preparatory to the first cutting step. The air expelling unit has a roller which is lowered onto the stock adjacent the hold-down device and is then moved along the stock toward the feeding unit to expel air from pockets between the sheets. A cover is placed between the roller of the air expelling unit and the stock so that the roller need not directly engage the topmost sheet of the stock. A pusher is provided on the feeding units to shift the stock against a lateral stop upon completion of the air expelling step but prior to the first severing step.

23 Claims, 4 Drawing Sheets

MACHINE FOR CUTTING STACKS OF PAPER SHEETS AND THE LIKE

CROSS-REFERENCE TO RELATED CASES

Cutting machines which are somewhat similar to the machine of the present invention are disclosed in my copending U.S. patent applications Ser. No. 038,880 (filed Apr. 15, 1987), Ser. No. 038,886 (filed Apr. 15, 1987) and Ser. No. 041,730 (filed Apr. 23, 1987, now U.S. Pat. No. 4,757,731 granted July 19, 1988).

BACKGROUND OF THE INVENTION

The invention relates to improvements in cutting machines in general, and more particularly to improvemens in guillotine type cutting machines which can be used with advantage to subdivide stacks of superimposed paper sheets into smaller stacks, e.g., to divide large stacks of superimposed labels into smaller stacks.

A guillotine type cutting machine normally comprises a table which supports the stock to be severed, a knife which is movable up and down to sever the stock in a predetermined cutting plane, a hold-down device which bears upon the stock adjacent the cutting plane in the course of the cutting operation, and means for feeding the stock into the range of the cutter, i.e., along the table. Certain presently known guillotine type cutting machines are manufactured by Maschinenfabrik Adolf Mohr, German Federal Republic, and are known as "Polar". Reference may be had to German Pat. No. 27 23 162 and to German Offenlegungsschrift No. 31 01 911.

A drawback of many presently known cutting machines is that the stock on the table cannot be positioned and held with a sufficiently high degree of precision. This is attributable in part to the presence of air which is entrapped between the superimposed sheets of the stock as well as to other factors, such as the absence of adequate means for orienting the stock prior to actuation of the hold-down device.

OBJECTS AND SUMMARY OF THE INVENTION

An object of the invention is to provide a novel and improved quillotine type cutting machine wherein one or more stacks of superimposed paper sheets can be subdivided into smaller stacks with a higher degree of accuracy than in heretofore known machines.

Another object of the invention is to provide the machine with novel and improved means for expelliing air from the stock on the table.

A further object of the invention is to provide air expelling means which is constructed, mounted and operated in such a way that it can embody or cooperate with components which can perform other useful functions.

An additional object of the invention is to provide the machine with a hold-down device which can perform its customary function of bearing upon the stock in the course of a cutting operation but can also perform other functions.

Still another object of the invention is to provide the machine with novel and improved means for orienting the stock upon completion of expulsion of air from and preparatory to subdivision into smaller stacks.

A further object of the invention is to provide the machine with novel and improved means for reducing the likelihood of creasing, contamination of and/or other damage to the stock during expulsion of air.

An additional object of the invention is to provide the machine with novel and improved means for facilitating accurate orientation of stock with reference to the table and the cutting plane.

A further object of the invention is to provide novel and improved means for holding the stock in the course of the air expelling operation.

Another object of the invention is to provide a novel and improved method of manipulating stock in a guillotine type cutting machine for superimposed paper sheets or the like, especially prior to the first cutting step.

The invention is embodied in a quillotine type machine for cutting stacked sheets of paper and similar stock. The machine comprises a table having a stock supporting surface, a knife which is movable up and down to sever the stock on the table in a predetermined cutting plane, means for feeding the stock along the supporting surface in a direction toward and normally substantially at right angles to the cutting plane, means for expelling air from the stock in the table, means for moving the expelling means along and on top of stock on the table between spaced-apart first and second positions, and a hold-down device which is adjacent the expelling means in the first position of the expelling means and serves to engage the stock during movement of the expelling means from one to the other of its positions. The hold-down device can comprise an elongated stock-engaging portion adjacent and substantially parallel to the cutting plane and means for biasing the stock-engaging portion against the stock on the table. The expelling means is preferably adjacent the cutting plane in its first position and is remote from the cutting plane in its second position. The moving means can include means for moving the expelling means counter to the direction of feed of stock along the supporting surface in order to move the expelling means from the first to the second position (i.e., to move the expelling means while the latter is in the process of expelling air (if any) from the spaces between superimposed sheets of the stock on the table). The biasing means can include means for urging the stock-engaging portion of the hold-down device against the stock on the table during movement of the expelling means from the one to the other position as well as during severing of stock on the table by the knife, i.e., one and the same hold-down device can be put to use in order to prevent shifting of stock or portions of stock with reference to the table in the course of the severing operation as well as to hold the stock or portions of the stock on the table against movement relative to the supporting surface while the expelling means is operative to perform its function by preferably moving in a direction from the cutting plane counter to the direction of feed of stock along the supporting surface toward and across the cutting plane. Such machine can further comprise means for adjusting the biasing means so as to urge the stock-engaging portion against the stock with a first force during movement of expelling means from the one to the other position and to urge the hold-down device against the stock with a second force during severing of the stock by the descending knife. The second force may but need not match the first force.

The expelling means can include an elongated rotary stock-compressing member (such as a small-diameter cylindrical roller) which is arranged to roll along the stock during movement of the expelling means from the one to the other position. The rotary stock-compressing member of the expelling means is or can be mounted in a support and the means for moving the expelling means can comprise a motor for moving the support and the rotary member along the supporting surface above the stock. Guide means can be provided for the support, and such guide means can include rails which flank the supporting surface and guide rolling elements on the lower end portions of the legs of a substantially gantry-like support for the rotary member.

The feeding means is movable with reference to the table to a retracted position in which the stock on the supporting surface is spaced apart from the retracted feeding means, and the expelling means is preferably located between the feeding means and the stock on the table in the other position of the expelling means and in the retracted position of the feeding means. This ensures complete expulsion of air from between the sheets of stock on the table.

The aforementioned stock-compressing member is preferably urged toward the stock in the table by a pressing means which can comprise two or more discrete pressing units (such as fluid-operated cylinder and piston units) which are spaced apart from each other in the longitudinal direction of the stock-compressing member. Cover means can be provided together with means for interposing the cover means between the stock on the table and the expelling means prior to movement of the expelling means from the one to the other position, i.e., the cover means is located between the stock-compressing member and the top of the stock. The cover means is or can be permeable to air and can include or constitute a flexible web the first end portion of which is adjacent the cutting plane and the second end portion of which can be moved toward or away from the first end portion. The interposing means can comprise means for moving the first end portion of the cover means up and down away from and into engagement with the stock on the table adjacent the cutting plane and means (such as a spring-biased takeup reel having a core connected to the second end portion of the web) for tensioning the web between its end portions. The width of the web can match, approximate or even exceed the width of the supporting surface of the table so that all of the stock on the table can be covered by the web in the course of the air expelling operation. The means for moving the expelling means can include means for moving the takeup reel jointly with the expelling means so that the first end portion of the web remains adjacent the cutting plane and the second end portion of the web moves with the expelling means in and counter to the direction of feed of stock toward and across the cutting plane. The means for moving the first end portion of the web up and down can comprise a crosshead which is connected to the first end portion of the web and elevator means for the crosshead. The latter can be disposed between the hold-down device and the expelling means.

The machine can further comprise a lateral stop which is adjacent the supporting surface and extends substantially at right angles to the cutting plane, and means for shifting the stock on the table against the stop, preferably upon completed expulsion of air from the stock. The shifting means can comprise at least one mobile pusher and means for displacing the pusher with reference to the feeding means (such displacing means can be mounted on the feeding means). Means (such as a pivot member) can be provided for movably mounting the pusher on the displacing means for movement between an operative position in which the pusher is adjacent the supporting surface and is located close to or actually in the path of movement of the expelling means, and an inoperative position in which the pusher is remote from such path so that the expelling means can be moved along the top of stock on the table. The displacing means can comprise a carrier (e.g., a block-shaped body) for the pusher and means for moving the carrier relative to the feeding means in substantial parallelism with the cutting plane and transversely of the direction of feed of stock along the table. Such means for moving the carrier can include a rotary feed screw which mates with the carrier and means (e.g., a reversible electric motor) for rotating the feed screw. The carrier and the pusher thereon can be pivoted or rocked in order to move the pusher between its operative and inoperative positions; such pivoting or rocking means can comprise a shaft along which the carrier is movable transversely of the direction of feed of stock along the table and means (such as a motor-driven lever) for rocking the shaft about the axis of the feed screw through a predetermined angle (e.g., through 90 degrees). Means can be provided for moving the pusher with reference to the displacing means in parallelism with the cutting plane and transversely of the direction of feed of stock on the table, and such moving means can comprise a single-acting or double-acting fluid-operated motor.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
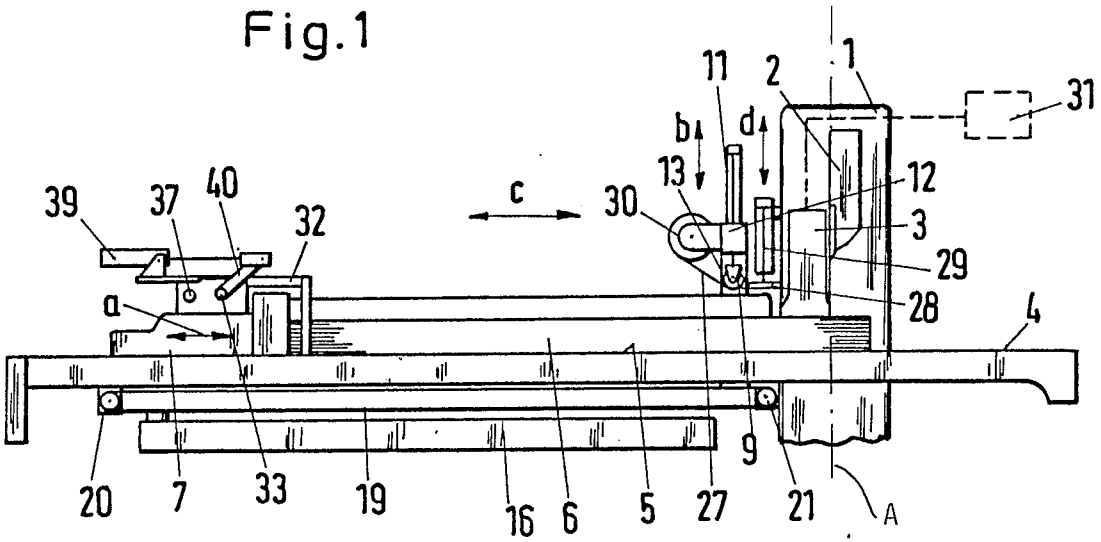
FIG. 1 is a schematic side elevational view of a guillotine type cutting machine which embodies one form of the invention, the air expelling means being shown in one of its positions adjacent the cutting plane and the means for feeding the stock along the table being shown in an extended position in which the front part of the stock on the table extends across the cutting plane.

FIG. 1 shows a guillotine type machine for cutting stock 6 on the supporting surface 5 of a horizontal table 4 which is mounted in a housing or frame 1. The frame 1 further supports a knife 2 whose cutting edge is movable up and down in a vertical cutting plane A (indicated in FIG. 1 by a phantom line) so as to sever the stock 6, i.e., to segregate the stock portion at the right-hand side from the stock portion at the left-hand side of the cutting plane. The frame 1 also supports a hold-down device 3 which is adjacent the left-hand side of the cutting plane A and is movable vertically up and down as indicated by a double-headed arrow d away from or into engagement with the upper side of stock 6 on the table 4 so as to hold the left-hand portion of the stock against any movement relative to the supporting surface 5 during severing of the stock in the plane A. The stock-engaging portion of the hold-down device 3 can constitute an elongated heavy stock-engaging portion or crosshead which extends in parallelism with the cutting plane A and is movable up and down in the customary way, e.g., by one or more double-acting upright hydraulic or pneumatic cylinder and piston units one of which is indicated in FIG. 1 by a phantom line extending from the top of the stock-engaging crosshead of the hold-down device 3 to an adjusting means 31 which serves to regulate the bias of the cylinder and piston units upon the crosshead and to thus determine the magnitude of the force with which the hold-down device 3 bears upon the stock 6 adjacent the cutting plane A opposite the knife 2.

The means 7 for feeding stock along the supporting surface 5 of the table 4 in a direction toward the knife 2 and at right angles to the cutting plane A comprises a pusher which is movable back and forth in directions indicated by a double-headed arrow a, e.g., by a cylinder and piston unit, by a rack and pinion drive or by any other suitable means not forming part of the invention.

Figure 2:
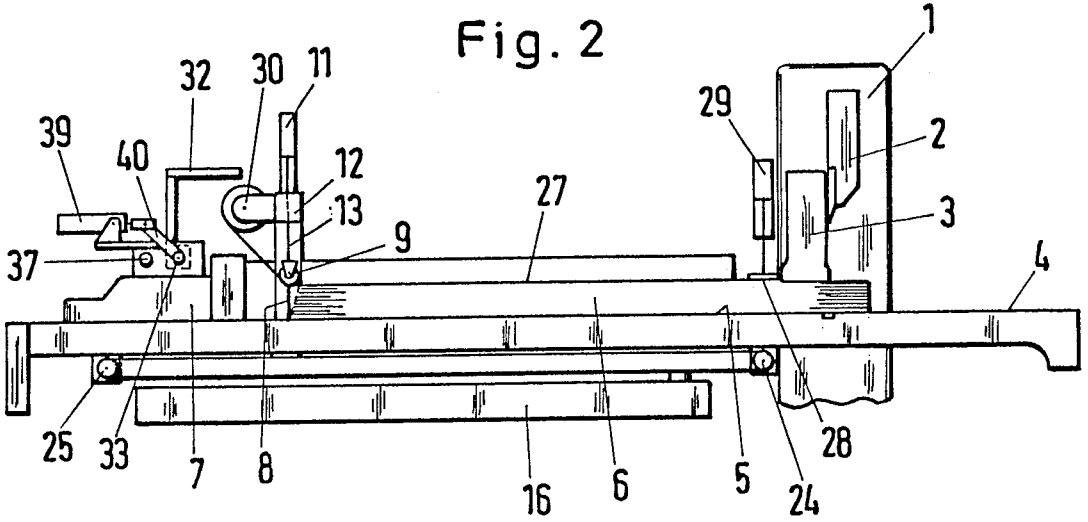
FIG. 2 shows the structure of FIG. 1 but with the feeding means in retracted position and the air expelling means in the other of its positions, namely between the feeding means and the stock on the table.

When the stock-engaging crosshead of the hold-down device 3 descends and the cylinder and piston units of the hold-down device urge the crosshead against the adjacent portion of the stock 6 with a pronounced force which is selected by the adjusting means 31, some sheets of the stock 6 tend to move lengthwise toward the cutting plane A so that the rear edge face 8 of the stock 6 on the table 4 (see FIG. 2) is no longer vertical or even nearly vertical. The machine comprises a novel and improved air expelling unit 9 which is designed to expel air (if any) from pockets between the sheets of the stock 6 and to thereby at least slightly restore the desired (vertical) shape of the rear edge face 8. FIG. 2 shows that the foremost part of the stock 6 is compressed by the crosshead of the hold-down device 3, i.e., that the thickness of such foremost part is less than the thickness or height of the stock in the region of its rear edge face 8. It is desirable to cause the entire rear edge face 8 to assume its original vertical position because this ensures that the front side of the feeding means 7 comes into full contact with the entire edge face 8 when the feeding means 7 is caused to advance the stock 6 by a step so as to move another part of the stock across the cutting plane A.

The air expelling unit 9 comprises a small-diameter stock-compressing roller which is parallel to the cutting plane A and is mounted in an inverted U-shaped yoke 10 (see FIG. 4) whose end portions carry bearings for stubs at the ends of the roller. Two spaced-apart intermediate portions of the yoke 10 are connected with discrete pressing means in the form of cylinder and piston units 11 (see FIG. 3) serving to move the yoke 10 and the roller of the air expelling unit 9 up and down (note the double-headed arrow b in FIG. 1) away from and toward the upper side of the adjacent part of stock 6 on the table 4. The roller of the air expelling unit 9 is adjacent the cutting plane A in one of its end positions and to the gap between the feeding means 7 (while the feeding means is retracted) and the rear edge face 8 of stock 6 on the table 4 in the other of its end positions. The cylinder and piston units 11 are suspended on the transversely extending beam 12 of an inverted U-shaped qantry-like support 13 whose downwardly extending legs flank the table 4 and are movable along two elongated parallel guide rails 17, 18 (see FIGS. 3 and 4) by a motor 16. The rods 14 extend upwardly through and are guided by sleeves 15 at the upper side of the beam 12. The cylinder and piston units 11 can move the yoke 10 and the roller of the air expelling unit 9 up and down in response to admission of compressed air or another fluid into their lower or upper chambers in a manner which is well known from the art of double-acting fluid operated motors. The directions in which the motor 16 can reciprocate the support 13 are indicated in FIG. 1 by a double-headed arrow c.

The motor 16 is disposed at one side of the table 4 and serves to drive a chain 19 which is attached to one leg of the support 13 and is trained over sprocket wheels 20, 21 on shafts 25, 24 journalled in suitable bearings at the underside of the table 4. The other leg of the support 13 is connected with a second endless chain 22 which is trained over sprocket wheels (not identified) at the respective ends of the shafts 24, 25.

In accordance with a feature of the invention, the roller of the air expelling unit 9 does not bear directly upon the top surface of the topmost sheet of the stock 6 on the table 4 because the machine further comprises a flexible cover 27 in the form of a web or strip of textile or other material which is permeable to air (note the apertures 26 in FIG. 3) and has a front end portion adjacent the cutting plane A and a rear end portion connected to the core of a rotary tensioning device in the form of a spring-biased takeup reel 30 mounted on the beam 12 of the support 13 behind the roller of the air expelling unit 9. The web which constitutes the cover 27 is preferably designed or reinforced in such a way that it exhibits a certain resistance to flexing transversely of the directions indicated by the arrow c but is readily or more readily flexible in a sense to facilitate its winding onto or its unwinding off the core of the takeup reel 30. The front end portion of the cover 27 is connected with a horizontal crosshead 28 which is parallel to the beam 12 and to the cutting plane A and is movable up and down by an elevator including one, two (see FIG. 3) or more fluid-operated motors 29.

The operation of the machine is as follows:

In order to expel air from the stock 6 (e.g., from a series of elongated narrow stacks of superimposed paper sheets or the like) on the supporting surface 5 of the table 4, the stock 6 is advanced forwardly by the feeding means 7 so that a selected portion of the advanced stock extends across the cutting plane A (this is shown in FIG. 2). The hold-down device 3 is then caused to lower its crosshead and to move the crosshead into compressive engagement with the stock 6 at a location immediately to the left of the cutting plane 6. This expels air from the respective portion of the stock 6 and normally also from the stock portion at the other side of the cutting plane A. The adjusting means 31 is then set to cause the crosshead of the hold-down device 3 to act upon the stock 6 with a force which is or can be weaker than the force to be applied in the course of the actual severing operation but suffices to ensure that the topmost sheets of stacks which form the stock 6 on the table 4 are not shifted in response to advancement of the roller of the air expelling unit 9 from the position of FIG. 1 toward and all the way to the position of FIG. 2. The adjusting means 31 can include a suitable valve which regulates the pressure of pressurized hydraulic or pneumatic fluid in conduit means between a source of pressurized fluid and the cylinder and piston units which can move the crosshead of the hold-down device 3 up and down. It is also possible to replace the valve or valves with one or more adustable flow restrictors or with any other suitable means for regulating the pressure of fluid which acts upon the crosshead of the hold-down device 3 in order to maintain it in contact with the stock 6 adjacent the cutting plane A.

In the next step, the crosshead 28 of the means for moving the front end portion of the cover 27 up and down is lowered by the elevator including the fluid-operated motors 29 so that the front end portion of the cover overlies the stock 6 between the crosshead of the hold-down device 3 and the roller of the air expelling unit 9 (such roller is then held in the position of FIG. 1).

The next step includes actuation of the cylinder and piston units 11 which react against the gantry-like support 13 and act upon the yoke 10 to urge the roller of the air expelling unit 9 against the upper side of the cover 27 immediately or closely adjacent the crosshead 28 which is connected with the front end portion of the cover 27. The pressure in the motors 11 is preferably adjustable so that it is possible to regulate the bias of the roller upon the cover 27 and hence the air expelling action of the unit 9. The motor 16 is then started to move the support 13 from the position of FIG. 1 to the position of FIG. 2 while the feeding means 7 is held in the retracted position. The roller of the unit 9 rolls along the upper side of the cover 27 which is being paid out by the takeup reel 30 on the beam 12 because the takeup reel shares the movement of the air expelling unit toward the feeding means 7. Any air which is entrapped between the upper side of the stock 6 and the cover 27 can escape through the apertures 26. A guillotine type cutting machine is normally designed in such a way that the feeding means can be retracted away from the rear edge face of stock on the table so that it is not even necessary to specially design the machine with a view to ensure that the roller of the air expelling unit 9 can enter the gap between the rear edge face 8 of the stock 6 on the table 4 and the retracted feeding means 7.

The roller and the yoke 10 of the air expelling unit 9 are thereupon lifted by the motors 11 toward the beam 12 of the support 13 before the motor 16 is started to return the unit 9 to the position of FIG. 1. At such time, the takeup reel 30 automatically collects the cover 27 so that the latter remains tensioned between the takeup reel and the crosshead 28 which is connected to the front end portion of the cover. The crosshead 28 is also lifted by the elevator 29 so that the front end portion of the cover 27 is lifted above and away from the stock 6 which by then is devoid of entrapped air. The hold-down device 3 need not necessarily be lifted upon completion of the air expelling operation and preparatory to and during making of the first cut across the stock 6. However, the device 3 will be lifted if the operator wishes to adjust the position of the stock 6 on the table 4 upon completion of the air expelling operation but prior to the first cutting step. Such adjustment is carried out by a shifting unit which includes a pusher 32 serving to move the stock 6 on the table 4 at right angles to the direction of feed and against one of two lateral stops 34 (see FIG. 3) which flank the table 4 and are secured to the table or to the frame 1. The distance between the lateral stops 34 can equal or approximate the width of the supporting surface 5 and the width of the cover 27.

The pusher 32 is mounted for pivotal movement about the horizontal axis of a pivot member 33 so that it can be pivoted between the operative position of FIG. 1 (adjacent the supporting surface 5 of the table 4) and a raised or inoperative position (FIG. 2) in which it is invariably located outside of the path of movement of the air expelling unit 9 between its two end positions shown in FIGS. 1 and 2. As can be seen in FIG. 2, the inoperative position of the pusher 32 is selected in such a way that the pusher is located at a level above the takeup reel 30 for the cover 27. When in such inoperative position, the pusher 32 does not interfere with forward movement of the feeding means 7 all the way to the cutting plane A.

Figure 3:
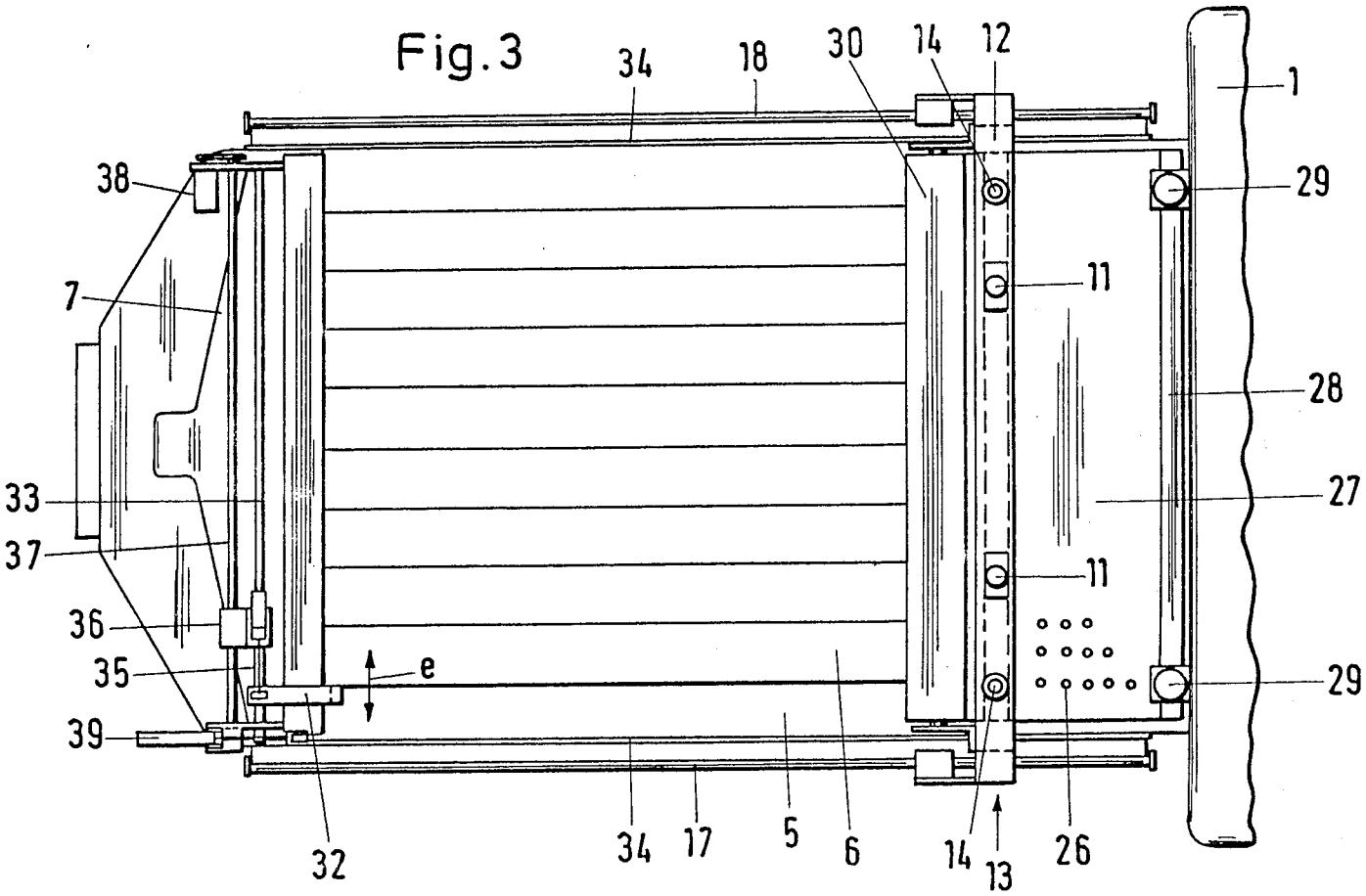
FIG. 3 is a schematic plane view of the machine, with the air expelling means located in an intermediate position.
Figure 4:
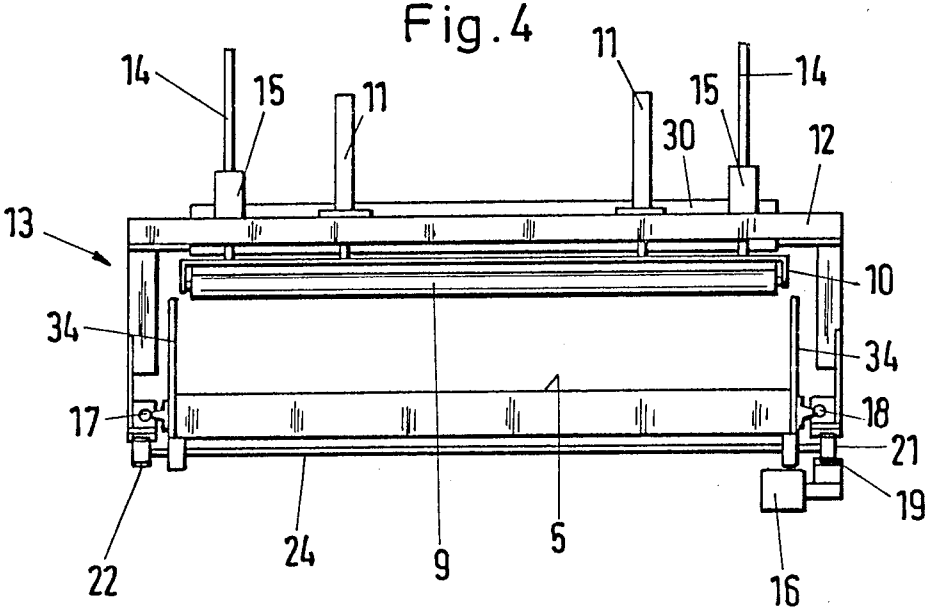
FIG. 4 is a front elevational view of the machine as seen from the right-hand side of FIG. 1 or 2, with the knife and certain other parts omitted.

The pusher 32 is movably connected to a block-shaped carrier 36 by a double-acting fluid-operated (e.g., pneumatic) cylinder and piston unit 35. The carrier 36 is movable along the feeding means 7 in response to rotation of a feed screw 37 which mates with an internal nut of the carrier an can be rotated by a reversible electric motor 38. The axis of the feed screw 37 is parallel to the cutting plane A and extends at right angles to the directions of forward and return movement of the feeding means 7. The directions in which the pusher 32 can be moved by the carrier 36 in response to rotation of the feed screw 37 are indicated by a double-headed arrow e (FIG. 3). The pivot member 33 is a shaft or rod which has a polygonal or other non-circular profile and is parallel to the feed screw 37. A fluid-operated (e.g., pneumatic) motor 39 is provided to rock the pivot member 33 back and forth through the medium of a lever 40 so that the pusher 32 is caused to change its angular position through an angle of 90 degrees in order to assume the end position of FIG. 1 or the end position of FIG. 2.

The operation of the improved machine can be programmed to any desired extent so that various steps will be carried out in a predetermined sequence and at predetermined intervals. Furthermore, the construction of the machine can be modified in a number of ways without departing from the spirit of the invention. For example, the cover 27 can be removed or rendered inactive when the stock 6 on the table 4 consists of very large sheets which are less likely to change their mutual positions and their positions with reference to the table 4 than the sheets of numerous relatively narrow or small stacks on the supporting surface 5 while the unit 9 is being actuated to expel air from the stock.

It is also possible reverse the direction of movement of the roller of the air expelling unit 9, namely the roller can move from the feeding means 7 toward the cutting plane A while it expels air from the stack. This renders it necessary to provide a second hold-down device (not shown) in the region of the feeding means 7 so that the rearmost portions of the stacks which forms the stock 6 on the table 4 can be held against movement while the roller of the unit 9 advances from the feeding means toward the knife and the raised hold-down device 3. It is also possible to employ a second hold-down device adjacent the device 3 and to use the second hold-down device only during expulsion of air. The device 3 is then used only during cutting.

The various prime movers which are used in the machine can constitute hydraulic, pneumatic, electric or other suitable motors. These prime movers include the motor or motors which move the crosshead of the hold-down device 3 up and down, which move the knife 2 up and down, which move the crosshead 28 up and down, which move the support 13 along the rails 17, 18, which move the pusher 32 relative to the carrier 36, which move the carrier 36 transversely of the table 4, which move the pusher 32 between its operative and inoperative positions, and which move the yoke 10 for the roller of the air expelling unit 9 up and down with reference to the support 13. It is also possible to automate the operation of the adjusting means 31.

Integration of the air expelling unit 9 into the cutting machine ensures that air can be expelled from the stock 6 immediately prior to the first cutting step and, if desired, also between successive cutting steps. This ensures that the height or thickness of the stock matches or only slightly exceeds the combined thickness of the sheets therein and greatly reduces the likelihood of shifting of sheets relative to each other and/or relative to the table 4. The reason is that severing does not involve additional pronounced reduction of thickness of the stock in the region of the cutting plane A so that the hold-down device 3 and/or the descending knife 2 does not pull the sheets of the stock 6 forwardly (away from the feeding means 7). It has been found that expulsion of air from the stock 6 prior to the first cutting step or prior to each cutting step results in a drastic reduction of misalignment of sheets in the severed stock. The likelihood of shifting of sheets relative to each other and/or relative to the table 4 is further reduced due to the fact that, once the stock 6 is properly located on the table 4 for the making of the first cut, the extent to which the stock must be shifted on the table prior to the making of additional cuts is relatively small.

Another important advantage of the improved machine is that the hold-down device 3 which is used to press upon the stock 6 adjacent the cutting plane A in the course of a severing operation can also serve as a means for bearing upon the stock in the region where the roller of the air expelling unit 9 is located before it begins to expel air from the pockets (if any) between the sheets. Thus, the hold-down device 3 can perform a dual function and this contributes to lower cost, simplicity and compactness of the machine. All that is necessary in order to enable the hold-down device 3 to perform such dual function is to select the operation of the air expelling device 9 in such a way that its roller expels air from the stock 6 while moving in a direction from the cutting plane A toward the feeding means 7. The utilization of a single hold-down device 3 renders it possible to further simplify the entire machine because one and the same adjusting means 37 can be used to regulate the force with which the device 3 bears upon the stock 6 in the course of a severing operation as well as while the roller of the air expelling unit 9 advances from the cutting plane A toward the feeding means 7. As a rule, or at least in many instances, the force with which the crosshead of the hold-down device 3 bears upon the stock 6 during expulsion of air is smaller than the force which is required to properly clamp the stock to the table 4 in the course of a severing operation. The roller of the air expelling unit 9 can be replaced with a runner which slides (rather than rolls) along the upper side of the stock 6 or along the upper side of the cover 27. A roller is preferred at this time because friction between its peripheral surface and the cover 27 or the stock 6 is minimal. A reduction of friction between the air expelling unit 9 and the stock 6 or cover 27 is desirable and advantageous because this further reduces the likelihood of any shifting of sheets when the air expelling unit is in actual use.

An advantage of the gantry-like support 13 is that it does not interfere with the advancement of stock 6 along the table 4 by the feeding means 7 and/or with the operation of the means 28–30 for interposing the cover 27 between the stock and the roller of the air expelling unit 9. Moreover, the distribution of stresses during movement of the support 13 is more satisfactory because each leg of the support is supported by and guided along a discrete rail (17, 18).

The distance between the feeding means 7 (in retracted position) and the rear edge face 8 of the stock 6 on the table 4 need not be pronounced, as long as it suffices to permit a movement of the roller of the air expelling unit 9 all the way to and even rearwardly beyond the edge face 8. This ensures reliable expulsion of air all the way from the hold-down device 3 to the edge face 8.

The number of pressing means 11 for the yoke 10 which carries the roller of the air expelling unit 9 will depend on the desired degree of uniformity of distribution of stresses along the roller of the unit 9. It has been found that two properly spaced apart pressing means 11 often suffice, but the number of such pressing means can be increased to three or more without departing from the spirit of the invention. If the width of stock 6 on the table 4 is substantially less than the distance between the lateral stops 34, one of the illustrated pressing means 11 can be deactivated. For example, the lower pressing means 11 of FIG. 3 can be deactivated if the stock 6 on the table includes only one narrow stack or a few narrow stacks of elongated strip-shaped sheets all of which are adjacent the upper lateral stop 34.

The cover 27 and the means 28–30 for interposing it between the stock 6 on the table 4 and the roller of the air expelling unit 9 constitute an optional but desirable feature of the machine. Such cover enhances the stability of the stock and reduces the likelihood of lateral shifting of sheets toward the one and/or the other lateral stop 34 during expulsion of air, especially if the stock includes several elongated stacks of narrow strip-shaped sheets (see FIG. 3). The apertures 26 are desirable because they allow air to escape between the underside of the cover 27 and the topmost sheet or sheets of the stock 6 and also because they prevent the topmost sheet or sheets of the stock from adhering by suction to the underside of the cover 27 when the latter is lifted off the stock on the table 4. The provision of elevator means 29 for the crosshead 28 which carries the front end portion of the cover 27 and of the tensioning means (takeup reel 30) for the rear end portion of the cover 27 ensures that such cover can be manipulated (if necessary in a fully automatic way) to place it on top of the stock or to lift it off the stock in order to avoid interference with the operation of the knife 2, of the hold-down device 3, of the air expelling unit 9, of the pusher 32 and/or of the feeding means 7. Mounting of the takeup reel 30 on the support 13 for the roller of the air expelling unit 9 ensures that the cover 27 is out of the way when it is not in actual use because the entire cover is then immediately adjacent the cutting plane A so that the entire or the major part of at least the supporting surface 5 of the table 4 is accessible.

The pusher 32 is preferably actuated upon completion of the air expelling operation. This ensures that air can be expelled rearwardly as well as sideways (toward the lateral stops 34). It is further possible to extend the pusher 32 toward the cutting plane A and/or to use an additional pusher adjacent the cutting plane. As a rule, it suffices to provide a pusher from the rear portion of the stock 6 on the table 4 because the front portion of such stock can be pushed sideways by hand.

The fluid-operated motor 35 acts as a hydraulic or pneumatic damping device which yields when the pusher 32 bears against the adjacent side of the stock 6 on the table 4 with a predetermined maximum permissible force. Moreover, minor lateral shifting of the rear portion of the stock 6 on the table 4 can be effected by actuating the motor 35 while the motor 38 remains idle.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A guillotine type machine for cutting stacked sheets of paper and similar stock, comprising a table having a stock supporting surface; a knife movable up and down to sever the stock on said table in a predetermined cutting plane; means for feeding the stock along said surface in a direction toward and substantially at right angles to said plane; means for expelling air from the stock on said table; means for moving said expelling means along and on top of the stock on said table between spaced-apart first and second positions; a hold-down device adjacent said expelling means in the first position of said expelling means and arranged to engage the stock during movement of the expelling means from one to the other of said positions; cover means; and means for interposing said cover means between the stock on said table and said expelling means prior to movement of said expelling means from said one to said other position.

2. The machine of claim 1, wherein said hold-down device comprises an elongated stock-engaging portion adjacent and substantially parallel to said plane and means for biasing said portion of said hold-down device against the stock on said table, said expelling means being adjacent said plane in the first position and being remote from said plane in the second position thereof.

3. The machine of claim 2, wherein said moving means includes means for moving said expelling means counter to said direction from said first to said second position.

4. The machine of claim 2, wherein said biasing means includes means for urging said portion of said hold-down device against the stock on said table during movement of said expelling means from said one to said other position and during severing of stock by said knife.

5. The machine of claim 4, further comprising means for adjusting said biasing means so as to urge said portion of said hold-down device against the stock with a first force during movement of the expelling means from the one to the other position and to urge the hold-down device against the stock with a second force during severing of stock by the knife.

6. The machine of claim 5, wherein one of said forces is greater than the other of said forces.

7. The machine of claim 1, wherein said expelling means includes a rotary member which is arranged to roll along the stock during movement of the expelling means from said one to said other position.

8. The machine of claim 1, wherein said expelling means includes a stock-comprising member and a support for said member, said moving means including motor means for moving said support and said stock-compressing member along said surface, and further comprising guide means for said support.

9. The machine of claim 8, wherein said support includes a gantry which extends across said support surface and said guide means includes rails flanking said surface.

10. The machine of claim 1, wherein said feeding means is movable with reference to said table to a retracted position in which the stock on said table is spaced apart from said feeding means, said expelling means being located between said feeding means and the stock on said table in said other position of the expelling means and in the retracted position of said feeding means.

11. The machine of claim 1, wherein said expelling means includes an elongated stock-compressing member and means for pressing said member toward the stock on said table, said pressing means comprising at least two pressing units which are spaced apart from one another in the longitudinal direction of said member.

12. The machine of claim 1, wherein said cover means is permeable to air.

13. The machine of claim 1, wherein said cover means includes a flexible web having a first end portion adjacent said plane and a second end portion, said interposing means including means for moving said first end portion up and down away from and into engagement with the stock on said table and means for tensioning the web between said end portions thereof.

14. The machine of claim 13, wherein said surface has a predetermined width and said web has a width which equals or approximates the width of said surface.

15. The machine of claim 13, wherein said tensioning means comprises a takeup reel for said web.

16. The machine of claim 15, wherein said moving means includes means for moving said takeup reel jointly with said expelling means.

17. The machine of claim 13, wherein said means for moving the first end portion of the web up and down comprises a crosshead connected to said first end portion and elevator means for said crosshead, said crosshead being disposed between said hold-down device and said expelling means.

18. The machine of claim 1, further comprising a lateral stop adjacent said supporting surface and extending substantially at right angles to said plane, and means for shifting the stock on said table against said stop upon completed expulsion of air from the stock.

19. The machine of claim 18, wherein said shifting means comprises a mobile pusher and means for displacing said pusher with reference to said feeding means.

20. The machine of claim 19, further comprising means for movably mounting said pusher on said displacing means or movement between an operative position in which the pusher is adjacent said supporting surface and close to or in the path of movement of said expelling means, and an inoperative position in which the pusher is remote from said path.

21. The machine of claim 19, wherein said displacing means comprises a carrier for said pusher and means for moving said carrier relative to said feeding means in parallelism with said plane and transversely of said direction including a rotary feed screw mating with said carrier and means for rotating said feed screw.

22. The machine of claim 21, further comprising means for pivoting said carrier with reference to said feed screw including a shaft along which said carrier is movable transversely of said direction and means for rocking said shaft about the axis of said feed screw through a predetermined angle.

23. The machine of claim 19, further comprising means for moving said pusher with reference to said displacing means including a fluid-operated motor.

* * * * *